US010363445B2

(12) United States Patent
Boeke et al.

(10) Patent No.: US 10,363,445 B2
(45) Date of Patent: Jul. 30, 2019

(54) EXTINGUISHING METHOD AND SYSTEM USING A LIQUID SYNTHETIC EXTINGUISHING AGENT AND WATER

(71) Applicant: MINIMAX GMBH & CO. KG, Bad Oldesloe (DE)

(72) Inventors: Joachim Boeke, Duesseldorf (DE); Wolfgang Habitzl, Neumitterndorf (AT); Volker Bechtloff, Timmendorfer Strand (DE)

(73) Assignee: MINIMAX GMBH & CO. KG, Bad Oldesloe (DE)

( * ) Notice: Subject to any disclaimer, the term of this patent is extended or adjusted under 35 U.S.C. 154(b) by 0 days.

(21) Appl. No.: 15/111,948

(22) PCT Filed: Jan. 9, 2015

(86) PCT No.: PCT/EP2015/050328
§ 371 (c)(1),
(2) Date: Jul. 15, 2016

(87) PCT Pub. No.: WO2015/107007
PCT Pub. Date: Jul. 23, 2015

(65) Prior Publication Data

US 2016/0346580 A1 Dec. 1, 2016

(30) Foreign Application Priority Data

Jan. 17, 2014 (EP) ..... 14151689

(51) Int. Cl.
*A62C 35/13* (2006.01)
*A62C 37/44* (2006.01)
(Continued)

(52) U.S. Cl.
CPC ..... *A62C 35/13* (2013.01); *A62C 37/44* (2013.01); *A62C 99/0018* (2013.01);
(Continued)

(58) Field of Classification Search
CPC ..... A62C 35/13; A62C 35/68; A62C 37/44; A62C 99/0018; A62C 35/026; A62C 35/11; G08B 17/00
(Continued)

(56) References Cited

U.S. PATENT DOCUMENTS 2,292,794 A * 8/1942 Paradise ..... A62C 2/08 169/46
5,947,207 A * 9/1999 Conforti ..... A62C 37/42 169/47
(Continued)

FOREIGN PATENT DOCUMENTS

DE 19700578 A1 7/1998
DE 102006032503 A1 1/2008
(Continued)

*Primary Examiner* — Steven J Ganey
*Assistant Examiner* — Joseph A Greenlund
(74) *Attorney, Agent, or Firm* — Perkins Coie LLP

(57) ABSTRACT

A method for extinguishing objects or appliances, in which, once a fire signal has been detected at point in time t1, a first device (17) providing an extinguishing agent is triggered, for discharging a liquid synthetic extinguishing agent (14), via a separating device (8), a common conveying pipe (9) and at least one nozzle (10), and, once a second fire signal has been detected at point in time t2, a second device (18) providing an extinguishing agent is triggered for discharging water (3) or a water-based extinguishing agent via the separating device (8), the common conveying pipe (9) and the at least one nozzle (10) for extinguishing. A system is also provided for extinguishing objects or appliances.

6 Claims, 3 Drawing Sheets

(51) Int. Cl.

| | |
|---|---|
| ***A62C 99/00*** | (2010.01) |
| ***G08B 17/00*** | (2006.01) |
| *A62C 37/36* | (2006.01) |
| *A62C 35/02* | (2006.01) |
| *A62C 35/11* | (2006.01) |
| *A62C 35/68* | (2006.01) |

(52) U.S. Cl.
CPC ..... *G08B 17/00* (2013.01); *A62C 35/026* (2013.01); *A62C 35/11* (2013.01); *A62C 35/68* (2013.01); *A62C 37/36* (2013.01)

(58) Field of Classification Search
USPC ..... 169/46, 53, 72, 56, 60, 61, 68
See application file for complete search history.

(56) References Cited

U.S. PATENT DOCUMENTS 5,957,210 A * 9/1999 Cohrt ..... A62C 5/00 169/11
5,992,530 A * 11/1999 Sundholm ..... A62C 3/004 16/5
6,006,840 A * 12/1999 Sundholm ..... A62C 35/023 169/13
6,390,203 B1 * 5/2002 Borisov ..... A62C 3/07 169/60
7,343,981 B2 * 3/2008 Nappa ..... C07C 45/58 169/11
7,775,292 B1 * 8/2010 Romanco ..... A62C 35/02 169/16
7,806,195 B2 * 10/2010 Popp ..... A62C 3/08 169/14
8,360,163 B2 * 1/2013 Hauzer ..... A62C 37/40 169/46
8,418,774 B2 * 4/2013 Gensel ..... A62C 3/16 169/51
8,505,642 B2 * 8/2013 Cashion ..... A62C 99/00 169/26
8,662,192 B2 * 3/2014 Dunster ..... A62C 99/0072 169/14
8,791,826 B2 * 7/2014 Russwurm ..... G08B 29/18 340/607
8,813,858 B2 * 8/2014 Gatsonides ..... A62C 3/07 169/11
8,925,642 B2 * 1/2015 Meier ..... A62C 3/08 169/47
8,967,284 B2 * 3/2015 Sampson ..... A62C 5/006 169/12
9,033,061 B2 * 5/2015 Chattaway ..... A62C 37/44 169/11
9,035,243 B2 * 5/2015 Lenkeit ..... G08B 17/117 250/287
9,387,352 B2 * 7/2016 Habitzl ..... A62C 3/00
2006/0032939 A1 * 2/2006 Relyea ..... A62C 5/02 239/68
2006/0124321 A1 * 6/2006 Aamodt ..... A62C 3/0214 169/44
2010/0132963 A1 * 6/2010 Sprakel ..... A62C 35/023 169/46
2010/0212920 A1 * 8/2010 Lelic ..... A62C 5/008 169/46
2011/0056707 A1 * 3/2011 Gamble ..... A62C 5/02 169/14
2011/0253396 A1 * 10/2011 Claessen ..... A62C 35/68 169/46
2011/0253398 A1 10/2011 Mouri
2014/0069665 A1 * 3/2014 Fernstrum ..... A62C 3/07 169/46
2014/0158382 A1 * 6/2014 Ferguson ..... A62C 3/08 169/46
2014/0166319 A1 * 6/2014 Shaik ..... A62C 37/36 169/46
2016/0332012 A1 * 11/2016 Lenkeit ..... A62C 35/13

FOREIGN PATENT DOCUMENTS

EP 2594319 A1 5/2013
WO 2004098718 A1 11/2004

* cited by examiner

EXTINGUISHING METHOD AND SYSTEM USING A LIQUID SYNTHETIC EXTINGUISHING AGENT AND WATER

CROSS-REFERENCE TO RELATED APPLICATIONS

This application is a National Stage of International Application No. PCT/EP2015/050328, filed Jan. 9, 2013, which claims priority to European Application No. 14151689.8, filed Jan. 7, 2014. The entire disclosures of each of the above applications are incorporated herein by reference.

FIELD

The disclosure relates to a method for extinguishing objects or devices and a system for extinguishing objects or devices.

BACKGROUND AND SUMMARY

The disclosure is applicable wherever an efficient, environmentally friendly, reliable and cost-effective method for extinguishing a fire with a synthetic extinguishing agent and a corresponding extinguishing system are necessary for machines, systems, and devices in spaces and open regions.

Currently, water extinguishing systems, $CO_2$ extinguishing systems and powder extinguishing systems are used to protect machines, systems and devices in large spaces and open regions. The use of extinguishing gases such as argon, nitrogen and synthetic extinguishing agents in gaseous form, such as e.g. HFC-227ea, requires a tightly enclosed space, which generally is not provided in the case of applications in large and open spaces. Furthermore, an economic use of these extinguishing agents is not possible at these space dimensions.

In many of these object protection applications, the use of water, water-based extinguishing agent, e.g. water with admixtures such as e.g. wetting and foaming means, powder extinguishing agent and $CO_2$ is connected with significant disadvantages. Water leads to short-circuits, promotes corrosion and must be collected and disposed of in a targeted manner if it is contaminated by fire reaction products.

By generating water droplets with a very small diameter, an attempt is made by the use of water mist systems to obtain a higher extinguishing effect with, at the same time, a reduction in the amount of extinguishing water, but the physical properties of the water medium, in particular the trajectory of the water droplets influenced by the updraft of the fire, also restrict these applications.

$CO_2$, which is without residue, already puts persons at risks at low concentrations and is lethal at relatively high concentrations.

Prior to the prohibition of halon (the use of halons is still permitted in some countries outside of the EU and it is also still permitted within the EU with special permits), the synthetic extinguishing gas halon 1211 was used for many of these applications. Halon 1211, which is electrically non-conductive, residue-free and gaseous under ambient pressure, could also be used for the protection of objects in open regions due its properties and extinguishing mechanism.

The synthetic halon successive products as extinguishing agents, which were developed by the chemical industry, are primarily designed for the application in the gaseous phase and for use in tightly closed spaces within the space protection concept. This approach emerges primarily from the extinguishing mechanism of these synthetic extinguishing agents which, in contrast to the chemical chain termination reaction of halons, is based on the withdrawal of heat. In order to obtain this effect of the withdrawal of heat, a relatively long dwell time of the synthetic extinguishing agent at the flame, a relatively long reaction time of the extinguishing agent are required to reliably extinguish an energetic fire.

To date, no system and no solution with synthetic extinguishing agents which can be used for an object and device protection in the described form are available commercially. The attention of all commercially available and known system is mainly directed to the optimization of the evaporation of the synthetic extinguishing agents, which are stored in a liquid form, at the nozzles in order to obtain an extinguishing, homogeneous gaseous extinguishing agent/air mixture as quickly as possible in a tight enclosed space, which mixture can quickly withdraw heat from the fire.

WO 2004/098718A1 discloses a combined gas and spray water extinguishing system, comprising a common pipe system, wherein the combined system comprises an extinguishing gas supply device, an extinguishing water supply device, a common pipe, a fire detection device, a fire alarm and extinguishing control panel and also a spray water valve station and a selection valve in the gas supply line. The selection valve controls the extinguishing gas flow from the gas supply line directly into the common pipe to the extinguishing nozzles and said valve is controlled by an extinguishing control device which also actuates the spray water valve station and releases or blocks the flow of water directly into the common pipe to the extinguishing nozzles. WO 2004/098718A1 furthermore discloses a method for extinguishing a fire which, after extinguishing with the extinguishing gas without success, comprises the method step of manually triggering the water extinguishing system, with the manual trigger being carried out by an operator by way of pressing a spray water valve station switch.

DE 10 2006 032503 A1 has disclosed a method and a fire-fighting apparatus, in which at least one extinguishing fluid container is actuated by a propellant so as to discharge an extinguishing mist via at least one extinguishing mist nozzle and in which at least one extinguishing mist nozzle is actuated by a propellant, wherein the actuation of the extinguishing fluid container 2 and of the extinguishing gas nozzle 6 is carried out by way of a common propellant supply 8. In order to enable targeted actuation with either extinguishing fluid or extinguishing gas, it is proposed for only the extinguishing fluid container 2 or only the extinguishing gas nozzle to be selectively actuated with propellant by way of the common propellant supply 8.

EP 2594319 A1 has disclosed such a system for extinguishing or rendering inert, with a synthetic extinguishing agent, consisting of an extinguishing agent container, a pipe to the nozzles, and an event detector. In this system, the liquid synthetic extinguishing agent transitions into the gaseous phase at the extinguishing nozzles and it becomes effective at the flame, the seat of the fire, as a gaseous extinguishing agent, wherein some time passes until an extinguishing, homogeneous gaseous extinguishing agent/air mixture is built up at the flame, at the seat of the fire, and the extinguishing agent cannot act immediately, not quickly enough, onto the flame, onto the seat of the fire.

A further disadvantage of known systems of this type is that only a restricted volume of liquid synthetic extinguishing medium can be provided, and there cannot be further extinguishing in the case of re-ignition and resurgence of the fire after an extinguishing process has taken place and the liquid synthetic extinguishing agent has been completely used up.

In contrast thereto, as much synthetic extinguishing agent as possible must be introduced directly into the interaction zone in liquid form if quick extinguishing is required in the case of object protection applications. Evaporation of the liquid synthetic extinguishing agent at the nozzle would mean a loss of extinguishing effect, loss of influencing time of the extinguishing agent in the interaction zone.

Within the meaning of the disclosure, the term interaction zone is understood to mean the location at which the extinguishing effect develops, the flame and/or the combustion zone and/or the seat of the fire. In the case of a liquid synthetic extinguishing agent, the extinguishing effect lies in cooling (withdrawal of heat energy) and, in the case of a transition of the liquid extinguishing agent into the gaseous phase, there is the local oxygen displacement.

Proceeding from this prior art, it is therefore an object of the disclosure to develop a reliable, environmentally friendly and cost-effective solution for quickly and reliably extinguishing objects or devices in spaces, in particular in large or open spaces, in which a restricted amount of synthetic extinguishing agent is used, the latter acts intensively, and in which a fire is also reliably extinguished after the liquid synthetic extinguishing agent has been used up.

The solution according to the disclosure relates to a method for extinguishing objects or devices. The method according to the disclosure is carried out, in particular, using two different liquid extinguishing agents, which are provided by two separate extinguishing agent supply devices, in particular via a separation apparatus and a common pipe and at least one nozzle, wherein the first extinguishing agent supply device provides a liquid synthetic extinguishing agent and the second extinguishing agent supply device provides water or a water-based extinguishing agent in a water storage container and/or from water supply device. The liquid synthetic extinguishing agent, the first extinguishing agent supply, is preferably stored in, and provided from, an extinguishing agent container.

In a preferred alternative embodiment, the liquid synthetic extinguishing agent is stored in the pipe to the nozzles. In a further embodiment variant, storing the liquid synthetic extinguishing agent in the pipe is used in addition to the storage in the extinguishing agent container. This storage in the pipe reduces the time until the extinguishing agent is available for firefighting purposes at the seat of the fire in the case of a fire.

The method for extinguishing objects or devices comprises the following method steps, which are preferably carried out in succession: (a) detecting a first fire signal, in particular by at least one event detector and a fire alarm and/or extinguishing control panel, at the time $t_1$, (b) actuating a first extinguishing agent supply device, in particular by the fire alarm and/or extinguishing control panel, for discharging a liquid synthetic extinguishing agent, in particular by way of a separation station, a common pipe and at least one nozzle, (c) detecting a second fire signal at the time $t_2$, and (d) actuating a second extinguishing agent supply device and discharging water or a water-based extinguishing agent, in particular by way of the separation apparatus, the common pipe and the at least one nozzle, for extinguishing purposes.

The liquid synthetic extinguishing agent is preferably discharged from one or more extinguishing agent containers and/or the storage pipe, which is filled with the liquid synthetic extinguishing agent.

The method is particularly suitable for extinguishing objects or devices such as machines or systems in large and/or open spaces. Spaces or open spaces with the objects or devices to be protected constitute the protected regions.

The liquid extinguishing agents are guided by the common pipe to at least one nozzle and discharged by way thereof onto the seat of the fire in the vicinity of, or at, the object or the device in the protected region in order to extinguish the fire. In general, a plurality of nozzles are arranged; the number conforms to the size and form of the object or the device and the size of the protected region. If reference is only made to one nozzle below, particularly in the patent claims, then this always means at least one nozzle, i.e. also a multiplicity of nozzles. If reference is made below to the second extinguishing agent water, or only to water, then a water-based extinguishing agent is also always meant as an alternative. If more than one nozzle is arranged, the common pipe contains a distribution pipe network, which guides the extinguishing agent to the nozzles which are arranged around the object to be protected or around the device at predefined positions.

When using a plurality of nozzles, the common pipe has branchings, a distribution pipe network to the nozzles and optionally to other protected regions. Therefore, a common pipe is also understood to mean such a pipe network below, said pipe network being used to discharge both liquid extinguishing agents by the nozzles.

In an alternative embodiment, the pipe or the pipe network to the nozzles serves as extinguishing agent container. Here, the pipe is sealed by a trigger valve. The trigger valve is situated directly in the protected region and the nozzles are connected to short branch lines. The trigger valve comprises a trigger element which, in particular, reacts to the fire characteristic of heat. Alternatively, the trigger valve is provided with an electric trigger, e.g. with a magnetic lifting piston or a pyrotechnic trigger. The pyrotechnic trigger represents an electrically ignitable pyrotechnic element which exerts the action of a force for triggering.

In a further alternative embodiment, the pipe or the pipe network is sealed with sprinkler nozzles which comprise a glass barrel as an alternative to a trigger valve, wherein the glass barrels of the sprinklers are opened by trigger elements, e.g. magnetic lifting pistons or a pyrotechnic trigger. The advantage of this solution lies in the short flooding time.

Hence, the method for extinguishing objects or devices with the aforementioned method steps (a) to (d) can alternatively be embodied with a pipe or the pipe network to the nozzles as an extinguishing agent container and carried out containing the liquid synthetic extinguishing agent, wherein the pipe or the pipe network is sealed by a trigger valve and/or sprinklers and the sprinklers are activated in the case of fire by a trigger device (magnetic lifting piston/pyrotechnic trigger).

In an advantageous embodiment of the method, the liquid synthetic extinguishing agent constitutes a non-flammable, non-ignitable, electrically nonconductive liquid with a vapor pressure of 0.1 to 3 bar at 21° C. and/or it has a density of 1400 kg/m$^3$ to 1800 kg/m$^3$ at a temperature of 21° C.

In a further advantageous embodiment of the method, the liquid synthetic extinguishing agent is FK-5-1-12 ($C_4F_9OCH_3$). This is the extinguishing agent known under the trademark NOVEC 1230, which is FK 5-1-12 in the ASHRAE nomenclature. It is listed in the NFPA 2001 and ISO 14520 standards and also described by the chemical formulae ($C_4F_9OCH_3$) or 1,1,1,2,2,4,5,5,5-NONAFLUORO-4-(TRIFLUOROMETHYL)-3-PENTANONE.

In a further advantageous embodiment of the method, the liquid synthetic extinguishing agent is a fluoroketone.

In a further embodiment variant of the method, the liquid synthetic extinguishing agent is driven out of the extinguishing agent container by means of a pressurized gas, preferably nitrogen, and through the common pipe to the nozzle by the actuation of the first extinguishing agent supply device by the fire alarm and/or extinguishing control panel for discharging the liquid synthetic extinguishing agent, in particular from the extinguishing agent container by way of the pipe and the at least one nozzle. To this end, the fire alarm and/or extinguishing control panel transmits a control signal to a valve and/or to an apparatus for pressurizing the liquid synthetic extinguishing agent in the extinguishing agent container. In an advantageous embodiment, the pressurized gas is superimposed on the liquid synthetic extinguishing agent in the extinguishing agent container of the first extinguishing agent supply device. The pressure of the pressurized gas in the extinguishing agent container (1) is 25, 42 or 50 bar.

The extinguishing agent container is sealed by a valve which opens the extinguishing agent container when actuated by the fire alarm and extinguishing control panel and the extinguishing agent can be discharged.

In a further advantageous embodiment of the method, there is purging of the common pipe and the nozzle or nozzles using a gas, preferably nitrogen, after method step (b). Preferably, this is carried out with the residual pressurized gas from the extinguishing agent container for the liquid synthetic extinguishing agent. An advantage of this is that the common pipe and the nozzles do not have any liquid synthetic extinguishing agent, or only very small amounts thereof, and hence a reaction with the second liquid extinguishing agent, water or a water-based extinguishing agent, is avoided and hence corrosion in the common pipe and in components guiding an extinguishing means is avoided too.

In a further advantageous embodiment of the method, the liquid synthetic extinguishing agent is discharged via a conveying device from the extinguishing agent container by way of the common pipe and the at least one nozzle. Preferably, one or more pumps are used as conveying device or pressure increasing devices such as pyrotechnic gas generators or charge cartridges, which release gas with a predefined pressure if actuated when a fire signal is detected, said gas being guided into the extinguishing agent container for discharging the liquid synthetic extinguishing agent. In these embodiments, the first extinguishing agent supply device is actuated by the fire alarm and/or extinguishing control panel in method step (b) according to the disclosure by the transmission of control signals to the conveying device by way of the signal-conducting connection.

At least one event detector is present in the protected region to detect a fire signal. Preferably, these event detectors are arranged in the vicinity, on or even in the object to be protected. A fire signal is understood to mean the detection of a fire characteristic, which exceeds a predetermined threshold, or the manual actuation of the manual fire alarm, which transmits a fire single to a fire alarm and/or extinguishing control panel. The detection of a fire characteristic is carried out by the sensors in an event detector, preferably an automatic fire alarm.

Fire characteristics are understood to mean all characteristics such as e.g. smoke, heat and flame radiation and also fire gases, which characterize an arising or erupted fire. They are based on the measurement of physical variables such as the light scattering at smoke aerosols and/or the temperature, the electromagnetic radiation or the detection of fire gases such as CO, $NO_x$ or longer-chained hydrocarbons or other substances characterizing the smoldering fire. All measurement variables which serve to identify the fire are referred to as fire characteristics below.

Fire alarms are preferably arranged in the protected region as event detectors. Depending on the expected fire characteristics in a protected region, automatic fire alarms, such as smoke alarms, heat detectors, flame detectors, spark detectors, combusting gas detectors, smoke suction systems, and/or manual fire alarms to be actuated by hand are used as fire alarms.

The decision as to whether the detection of a fire characteristic is a fire signal is preferably made by appropriate evaluation algorithms in the electronic evaluation unit of the event detector, preferably the fire alarm. The fire signal can also constitute a pre-alarm in order to introduce suitable measures.

Preferably, the event detector transmits the fire signal by way of a signal-conducting connection to the fire alarm and/or extinguishing control panel, which then detects this fire signal.

Electric lines are preferably provided for the signal-conducting connection between event detector and fire alarm and/or extinguishing control panel. Alternatively, or additionally, the fire signal is transmitted by means of a wireless data transmission, for example by way of radio; then, the signal-conducting connection constitutes a radio connection.

The decision as to whether the detection of a fire characteristic is a fire signal can also be carried out by appropriate evaluation algorithms in an electronic evaluation unit of the fire alarm and/or extinguishing control panel, just like the detection of a fire signal by the manual actuation of a manual fire alarm.

In a particularly preferred embodiment of the method, the fire signal is counted as detected if it has been detected by the fire alarm and/or extinguishing control panel as a fire signal and said fire alarm and/or extinguishing control panel indicates a fire alarm and/or forwards this to a continuously occupied post.

The fire alarm control panel used for the method constitutes a reception and control panel which receives and evaluates the events from various event detectors, in particular fire signals from fire alarms, which are arranged in one or more protected regions, and then initiates follow-up actions. As a reaction, the fire alarm control panel acts as a control panel and display unit and it can actuate various technical devices as a subsequent action, for example: actuating an internal or external display panel and individual and collective displays, for example LEDs and displays for fire and event notifications forwarding a fire report to the constantly occupied control room in order to alert the fire services; triggering an evacuation alarm in order to evacuate a building or part thereof; actuating smoke outlet devices and/or fire protection shutter assemblies; switching off objects and devices to be protected, such as e.g. machines, computing devices; actuating an extinguishing system or an extinguishing agent supply apparatus and opening valves on extinguishing agent containers and on/in extinguishing fluid guiding components; controlling the extinguishing process.

An extinguishing control panel is connected to a fire alarm control panel or a monitoring control panel or a control system in a signal-conducting manner, receives a fire signal and actuates an extinguishing system, triggers the latter to discharge the extinguishing agent in the protected region, in which a fire is detected and controls the extinguishing progress, preferably by opening and possibly closing valves on extinguishing agent containers and/or on/in extinguishing fluid conducting components.

An extinguishing control panel for gas extinguishing systems or extinguishing systems with synthetic extinguishing agents can preferably partly or completely meet the requirements of EN12094-1.

A fire alarm and extinguishing control panel is a combined control panel, which has all components for satisfying the aforementioned functions and method of operation of a fire alarm control panel and an extinguishing control panel.

The fire alarm and/or control panel carries out all monitoring, controlling, regulating, alerting, and switching on and off that is required for the function of the system. In advantageous refinements, it can forward all switching and operating states to predefined reception devices such as building management systems. The fire alarm and/or extinguishing control panel is connected in a signal-conducting manner to both the conveying device and the fill-level and pressure monitoring device. Furthermore, the fire alarm and/or control panel detects and processes the signals from the event detectors. Moreover, the fire alarm and/or control panel can also be connected in a signal-conducting manner to the machines, systems and/or devices to be extinguished and switch these off or on.

The control unit of the fire alarm and/or extinguishing control panel which is connected by signal-technical means to the electronic evaluation unit of the fire signals initiates all follow-up actions, all actuations.

The control unit of the fire alarm and/or extinguishing control panel can be programmed and configured by way of various means, a personal computer, a tablet computer, a servicing or programming tool. To this end, use is made of a program interface present in or at the fire alarm and/or extinguishing control panel. By way of this means, it is possible to store parameters such as times, in particular a discharge time $t_c$, a checking time $t_k$, a monitoring duration $t_b$, in a memory of the control unit. The programming stored in the microcontroller system of the control unit then initiates the pre-programmed follow-up actions when detecting fire signals, in particular the actuation of extinguishing agent supply devices.

The programming stored in the microcontroller system of the control unit contains a test module, which generates a signal for actuating the second extinguishing agent supply device when a second fire signal is detected at the time $t_2$, if the test module determines that the time $t_2$ satisfies the inequality $(t_1+t_c)<t_2<(t_1+t_b)$, where $t_c$ represents the discharge time for complete discharge of the extinguishing agent container, $t_k$ represents the checking time following the discharge time $t_c$ and $t_b$ represents the monitoring duration, and wherein the monitoring duration $t_b$ is the sum of the discharge time $t_c$ and the checking time $t_k$, starting from the time $t_1$.

In an advantageous refinement, the control unit is configured in such a way that these parameters can be entered and/or modified, additionally or exclusively, by way of operating elements of the display and operating unit.

In an advantageous embodiment of the method, the central control unit of the fire alarm and/or extinguishing control panel is configured in such a way that the method step (b) is only initiated when two event detectors each detect a fire signal, preferably within a predetermined time interval. This increases the reliability of triggering the extinguishing process and reduces instances of erroneous triggering due to deceptive values. In this case, the central control unit is configured in such a way that only the reception of two fire signals from two fire alarms in a protected region causes the fire alarm and/or extinguishing control panel to evaluate this as a fire signal, as a first fire signal, and the actuation of the first extinguishing agent supply device is carried out as follow-up action.

In the preferred embodiment of the method, the actuation of the first extinguishing agent supply device is carried out by the fire alarm and/or extinguishing control panel by transmitting a control value to a valve, preferably to a magnetic valve, which is arranged on the extinguishing agent container or the component storing the extinguishing agent, and the valve opens and releases the extinguishing agent flow in the direction of the at least one nozzle.

The liquid synthetic extinguishing agent, which preferably is pressurized by gas, is discharged in the protected region over the seat of the fire by way of the at least one nozzle via the separation apparatus and the common pipe. In an alternative embodiment, a conveying device or a pump is actuated, which discharge the liquid synthetic extinguishing agent from the extinguishing agent container by way of the separation apparatus, the common pipe and the at least one nozzle.

In the method, the fire alarm and/or extinguishing control panel stores the time $t_1$, the time of detecting the first fire signal, preferably in the arranged event memory.

In an advantageous embodiment of the method, the power supply of the machine, system or device to be extinguished is switched off by way of the fire alarm and/or control panel at the time $t_1$ or after a predetermined delay duration $t_a$ following this, which delay duration may also assume the value of zero. As result, the energy supply for a possible source of fire origin is interrupted and/or a short-circuit is prevented.

The central control unit of the fire alarm and/or extinguishing control panel is embodied and configured in such a way that it has stored a predetermined checking time $t_k$ and a predetermined discharge time $t_c$ for the liquid synthetic extinguishing agent from the extinguishing agent container, by way of programming and configuration. The discharge time $t_c$ starts at the time $t_1$, which was stored when detecting the first fire signal by the fire alarm and/or extinguishing control panel. In an advantageous embodiment, the discharge time is the time of completely discharging a plurality of extinguishing agent containers, for example three extinguishing agent containers.

In the checking time $t_k$, which follows the discharge time $t_c$, the fire alarm and/or extinguishing control panel examines whether a further fire signal is detected. This may be the case if the fire is not yet extinguished by the extinguishing process using the liquid synthetic extinguishing agent, according to method step (a), if there is a re-ignition or re-eruption, or if a second fire breaks out.

The sum of the discharge time $t_c$ and the checking time $t_k$ results in a monitoring duration $t_b$, starting from the time $t_1$, at which the fire alarm and/or extinguishing control panel examines whether a second extinguishing stage with water or a water-based extinguishing agent needs to be carried out. These times therefore have the following functional relationship $t_b=t_c+t_k$.

If no fire signal is detected by at least one event detector and the fire alarm and/or extinguishing control panel up into the time $t_1+t_b$, the extinguishing process is complete.

The times $t_c$, $t_k$ and $t_b$ are also stored by programming and configuring the fire alarm and/or extinguishing control panel and therefore predetermined for the method.

In an advantageous refinement of the method, the time $t_2$ is after the complete discharge of the extinguishing agent container, after the discharge time $t_c$ has expired, but it lies within a monitoring duration $t_b$, wherein the monitoring duration $t_b$ is the sum of the discharge time $t_c$ and a checking time $t_k$, starting from the time $t_1$, where the checking time $t_k$ follows the discharge time $t_c$ and an examination is carried out during this time $t_k$, in particular by the fire alarm and/or extinguishing control panel, as to whether a fire signal is detected and whether the time $t_2$ satisfies the inequality $(t_1+t_c)<t_2<(t_1+t_b)$.

To this end, the central control unit of the fire alarm and/or extinguishing control panel is embodied and configured in such a way that, by way of programming and configuration, it actuates the second extinguishing agent supply device and the water or the water-based extinguishing agent is discharged by way of the separation apparatus, the common pipe and the at least one nozzle for extinguishing purposes if, at the time $t_2$, a second fire signal is detected by the event detector and the fire alarm and/or extinguishing control panel and this time $t_2$ is after the complete discharge of the extinguishing agent container within the monitoring duration $t_b$, and $t_2$ satisfies the inequality $(t_1+t_c)<t_2<(t_1+t_b)$.

Hence, the method according to the disclosure constitutes a two-stage extinguishing process controlled according to demand, with discharging of a liquid synthetic extinguishing agent for the first extinguishing stage and, if the fire has not been put out or re-erupts within a predetermined time $t_b$, water or water-based extinguishing agent is discharged as a second extinguishing stage.

In an advantageous embodiment of the method, there is, prior to method step (d) in the case of the detection of a second fire signal at the time t2, actuation of the separation apparatus by the fire alarm and/or extinguishing control panel for the purposes of generating a switch position of the separation apparatus which releases the transport path of the water or the water-based extinguishing agent in the direction of the common pipe and the at least one nozzle and completely blocks the transport path of the liquid synthetic extinguishing agent from the first extinguishing agent supply device in the direction of the common pipe and the nozzle. Like in method step (a), the fire signal is detected by the at least one event detector and the fire alarm and/or extinguishing control panel.

In a further advantageous refinement of the method, there is actuation of the separation apparatus by the fire alarm and/or extinguishing control panel, prior to method step (b), for the purposes of generating a switch position which releases the transport path of the liquid synthetic extinguishing agent in the direction of the common pipe and the at least one nozzle and completely blocks the transport path of the water or the water-based extinguishing agent from the second extinguishing agent supply device in the direction of the common pipe and the at least one nozzle.

In a particularly preferred embodiment, the volumetric flow of the synthetic extinguishing agent emerging from the nozzle is formed as a target-directed extinguishing agent jet with the geometry of a cone such that the synthetic extinguishing agent remains largely liquid in the center of the cone until it reaches the seat of the fire.

This is achieved by virtue of the extinguishing agent jet being with the geometry of a cone in such a way that a homogeneous distribution of the drops of the synthetic extinguishing agent over the cross-sectional area perpendicular to the axis of the drops is achieved.

In a particularly preferred embodiment of the method, the extinguishing agent portion which remained largely liquid is at least 80%. In a further embodiment of the method, this portion is more than 50%.

As a result of this, the evaporation of the extinguishing agent—the transition into the gaseous phase—only takes place in the direct vicinity of the seat of the fire. Test series have shown that this substantially increases the efficiency and the speed of the extinguishment. Thus, a twofold cooling effect is used, namely, the evaporation energy is withdrawn from the seat of the fire, i.e. the amount of heat required to bring the liquid synthetic extinguishing agent into the gaseous aggregate state is withdrawn, and the cooling effect of the gaseous synthetic extinguishing agent occurs thereafter. The synthetic extinguishing agent transitioned into the gaseous aggregate state forms a gaseous mixture with the air. This gaseous mixture made of synthetic extinguishing agent and air has a substantially higher thermal capacity than air on its own. This means, in turn, that this gaseous mixture takes up more thermal energy (heat energy) for each degree of temperature increase when heating, i.e. it withdraws more from the fire, the seat of the fire, than the normal ambient air. In the case of an appropriate design concentration of the system, the seat of the fire, the combustion zone, cools down so much the fire finally extinguishes. Additionally, the local oxygen displacement by the gaseous synthetic extinguishing agent acts substantially faster as the concentration of the gaseous synthetic extinguishing agent builds up directly at the seat of the fire during the evaporation in comparison with the evaporation of the liquid extinguishing agent at the nozzle.

The disclosure furthermore relates to a system for extinguishing objects or devices, comprising the following: a first extinguishing agent supply device with a liquid synthetic extinguishing agent in an extinguishing agent container, on which a valve is arranged; a second extinguishing agent supply device with a water storage container with water or a water-based extinguishing agent, or with a water supply device and a conveying device, which generates the volumetric flow and pressure for the water or the water-based extinguishing agent; a separation apparatus and a common pipe and at least one nozzle, wherein these components are embodied to provide the liquid synthetic extinguishing agent first and then, if required, water or a water-based extinguishing agent; at least one event detector, which is connected in a signal-conducting manner to a fire alarm and/or extinguishing control panel for detecting a fire signal, wherein the fire alarm and/or extinguishing control panel is configured in such a way that it actuates and opens the valve at the time $t_1$ if a first fire signal is detected, for the purposes of discharging the liquid synthetic extinguishing agent from the extinguishing agent container by way of the common pipe and the at least one nozzle, and it additionally actuates the conveying device if a second fire signal is detected at the time $t_2$, said conveying device discharging the water or the water-based extinguishing agent by way of the common pipe and the at least one nozzle for extinguishing purposes.

In a preferred embodiment of the system, a liquid synthetic extinguishing agent is stored in at least one closed extinguishing agent container, which is embodied as a pressure vessel, superimposed with a pressurized gas, preferably nitrogen. A valve closes this container. The system pressure of these extinguishing agent containers is monitored by way of pressure monitoring devices. A drop in the system pressure by a defined predetermined value in relation to the nominal pressure at 21° C. is detected as a fault by way of a signal-conducting connection to a fire alarm and/or extinguishing control panel, indicated by this control panel and/or transmitted to a reception or reporting device. The valve outlet of these extinguishing agent containers is connected in a fluid-technical manner to a separation apparatus by way of a check valve and a first supply line. From the separation apparatus, a pipe system leads to extinguishing nozzles which are arranged in and around the object to be protected or the region to be protected or the device to be protected.

In the second extinguishing stage, if a second fire signal is detected at the time $t_2$, the water is supplied either by means of a storage container or by means of a water supply device, e.g. an available water line, for example from the pipe of the public water supply. A conveying device, e.g. a pressure-increasing device, generates the volumetric flow and pressure required for discharging the water. The water storage and provision is monitored using pressure monitoring devices and/or fill-level monitoring devices, which are connected to the fire alarm and/or extinguishing control panel in a signal-conducting manner; a predetermined threshold of the pressure and/or the fill level being undershot by a predefined value is detected by the fire alarm and/or extinguishing control panel and indicated as a fault. Hence, it is possible to introduce steps to remedy the fault and bring the extinguishing system back into the operational state.

A fill-level monitoring device such as a mechanical float or electrical fill-level monitoring such as an ultrasonic measurement system can be arranged in the water storage container. A signal can be provided from the fill-level monitoring device to a fire alarm and/or control panel by way of electric lines, or else by radio.

It is advantageous to use a pump as a conveying device for the water, said pump being suitable for conveying or increasing the pressure of liquid media. Driving can be carried out electrically or pneumatically.

Alternatively, the conveying or the pressure increase in the water can be carried out by superimposing pressurized gas, preferably nitrogen.

The separation apparatus decouples the flow of the liquid synthetic extinguishing fluid from the flow of the water or the water-based extinguishing agent and ensures that there is no mixing of the two extinguishing fluids in the pipes or in the distribution pipe network. The separation apparatus is preferably embodied as a separation station, as is conventional in water extinguishing systems, or as a multi-port valve or as a different switchable valve or valve combination for opening and closing the transport paths of the liquid chemical extinguishing agent and the water or the water-based extinguishing agent.

At the extinguishing agent container for the synthetic extinguishing agent, a return flow preventer, preferably a check valve, prevents water from entering into this extinguishing agent container in the case of a malfunction of the separation apparatus. If use is made of a water storage container, it is also advantageous to attach a return flow preventer, preferably a check valve, here for preventing entry of synthetic extinguishing agent.

In a further advantageous embodiment, the return flow preventer at the extinguishing agent container for the synthetic extinguishing agent and the return flow preventer upstream of the water storage container form the separation apparatus. In this case, the valves of the return flow preventers have a signal-conducting connection to the fire alarm and/or extinguishing control panel.

The employed pipes for conveying the liquid synthetic extinguishing agent and the water can consist of metal or any other suitable fire-retardant materials. The pipes are preferably designed for the employed pressure stage of the liquid synthetic extinguishing agent, preferably 25, 42 or 50 bar. Any other pressure stage is also possible in other advantageous embodiments.

An advantageous refinement of the disclosure is distinguished by the fire alarm and extinguishing control panel being embodied and configured in such a way that, when it detects a second fire signal, it actuates the separation apparatus, prior to actuating the conveying device, for the purposes of generating a switch position which releases the transport path of the water or the water-based extinguishing agent in the direction of the common pipe and the nozzle and, at the same time, it blocks the transport path of the liquid synthetic extinguishing agent from the first extinguishing agent supply device in the direction of the common pipe to the nozzle.

The nozzles for discharging the liquid synthetic extinguishing agent and the water or the water-based extinguishing agent are nozzles which are optimized for the use with both extinguishing agents. The nominal widths of the pipes, nozzle cross sections, required pressures and volumetric flows for the liquid synthetic extinguishing agent and water or water-based extinguishing agent are established by means of hydraulic calculation and on the basis of trials with established design parameters.

Depending on the application, the at least one nozzle constitutes a full-cone nozzle and/or a hollow-cone nozzle and/or a fan nozzle in further advantageous embodiments of the system. When arranging a plurality of nozzles, arbitrary combinations of these nozzle types are applicable.

In a further embodiment variant of the system, the at least one nozzle has a nozzle bore with a widening opening.

In a particularly preferred embodiment of the system, the at least one nozzle is embodied in such a way that the volumetric flow of the liquid synthetic extinguishing agent emerging from the nozzle is formed as a target-directed extinguishing agent jet with the geometry of a cone such that the synthetic extinguishing agent remains largely liquid in the center of the cone. This is achieved by virtue of the nozzle being designed in such a way that a homogeneous distribution of the drops of the synthetic extinguishing agent is present perpendicular to the cone axis over the cross-sectional area.

In a particularly preferred embodiment of the method, the extinguishing agent portion which remained largely liquid is at least 80%. In a further embodiment of the method, this portion is more than 50%.

In a preferred embodiment variant, a return flow preventer is arranged in each case in front of the first extinguishing agent supply device and the second extinguishing agent supply device, preferably a check valve in each case. This prevents an ingress of water or a water-based extinguishing agent into the first extinguishing agent supply device and an ingress of synthetic extinguishing agent into the second extinguishing agent supply device.

In a further preferred embodiment variant, these return flow preventers form a separation apparatus, and so there is no need to use an additional separation apparatus.

In a further preferred embodiment of the system, the fire alarm and/or extinguishing control panel is configured and embodied only to actuate the second extinguishing agent supply device when the second fire signal is detected at the time $t_2$ if it has examined whether the time $t_2$ satisfies the inequality $(t_1+t_c)<t_2<(t_1+t_b)$, where $t_c$ represents the discharge time for the complete discharge of the extinguishing agent container, $t_k$ represents checking time following the discharge time $t_c$ and $t_b$ represents a monitoring duration and wherein the monitoring duration $t_b$ is the sum of the discharge time $t_c$ and the checking time $t_k$ starting from the time $t_1$.

Furthermore, it is advantageous if all of the nitrogen, which serves as a propellant, is discharged through the common pipe onto the seat of the fire after emptying the first extinguishing agent container and discharging the first liquid synthetic extinguishing agent. The discharge through the pipe between the nozzle and the separation station serves to clean the pipe before the water flows through the common pipe. This is expedient since water and a liquid synthetic extinguishing agent do not tolerate one another in all cases.

Both extinguishing agents reach the seat of the fire through the common pipe and the same distribution pipe network via the nozzles optimized for this dual application in both method stages, i.e. during the first stage of extinguishment with liquid synthetic extinguishing agent and during the second stage of extinguishment with water or water-based extinguishing agent.

The advantage consists of the fact that, as result of the solution according to the disclosure for the risk stage of a normal fire at or in the object to be protected or at or in a device, extinguishing is carried out quickly and reliably with the liquid synthetic extinguishing agent. For the risk stage of a larger fire or for a re-ignition or re-eruption of the fire, extinguishing is carried out with the more cost-effective extinguishing agent water or a water-based extinguishing agent. As result, the financial outlay is significantly reduced compared to extinguishing systems and methods which employ a synthetic extinguishing agent for all risk stages.

A further advantage consists of the solution according to the disclosure providing the option of extinguishing using water or a water-based extinguishing agent if the fire re-ignites or new fire breaks out in the time up to the establishment of the operational state of the first extinguishing agent supply device, i.e. up to after the refilling of the extinguishing agent container with liquid synthetic extinguishing agent.

It is advantageous to arrange a plurality of conveying devices between the extinguishing agent container and the nozzles and/or between the storage container for water or a water-based extinguishing agent and the nozzles. As a result of this, it is possible to discharge the extinguishing agent in different protected regions, in which an extinguishing process is intended to be carried out.

Furthermore, the use of a pressure switch, a contact manometer or a pressure sensor with a signal evaluation unit as a pressure monitoring device is advantageous.

Instead of one extinguishing agent container for a liquid synthetic extinguishing agent or one storage container for water or a water-based extinguishing agent, it may be advantageous to arrange a plurality of extinguishing agent containers or a plurality of storage containers.

The solution according to the disclosure is advantageous in that it combines the merits of an extinguishing system with a liquid synthetic extinguishing agent with the advantages of a conventional water extinguishing system. As a result of this, the disadvantage that systems with liquid synthetic extinguishing agent were previously not suitable for object protection is remedied. By way of an additional second extinguishing stage with water or a water-based extinguishing agent, the costs of the first extinguishing agent supply device with a liquid synthetic extinguishing agent are significantly reduced, with a high reliability and availability of the whole extinguishing system being a given. Moreover, material and system costs are saved by the common use of common pipes with a distribution pipe network and nozzles for the two different extinguishing agents.

The disclosure furthermore relates to a fire alarm and/or extinguishing control panel for actuating two extinguishing agent supply devices. According to the disclosure, the fire alarm and/or extinguishing control panel has a control unit which is configured to actuate a second extinguishing agent supply device when a second fire signal is detected at the time $t_2$ after actuating the first extinguishing agent supply device (17) when a first fire signal is detected at the time $t_1$, if it has examined whether the inequality $(t_1+t_c)<t_2<(t_1+t_b)$ is satisfied at the time $t_2$, where $t_c$ represents the discharge time for complete discharge of the extinguishing agent container (1), $t_k$ represents the checking time following the discharge time $t_c$ and $t_b$ represents the monitoring duration and the monitoring duration $t_b$ is the sum of the discharge time $t_c$ and the checking time $t_k$, starting from the time $t_1$.

Further advantageous or expedient features and refinements of the disclosure emerge from the dependent claims and from the description. Particularly preferred embodiments of the system and of the method are explained in more detail on the basis of the drawings.

DRAWINGS

DETAILED DESCRIPTION

Figure 1:
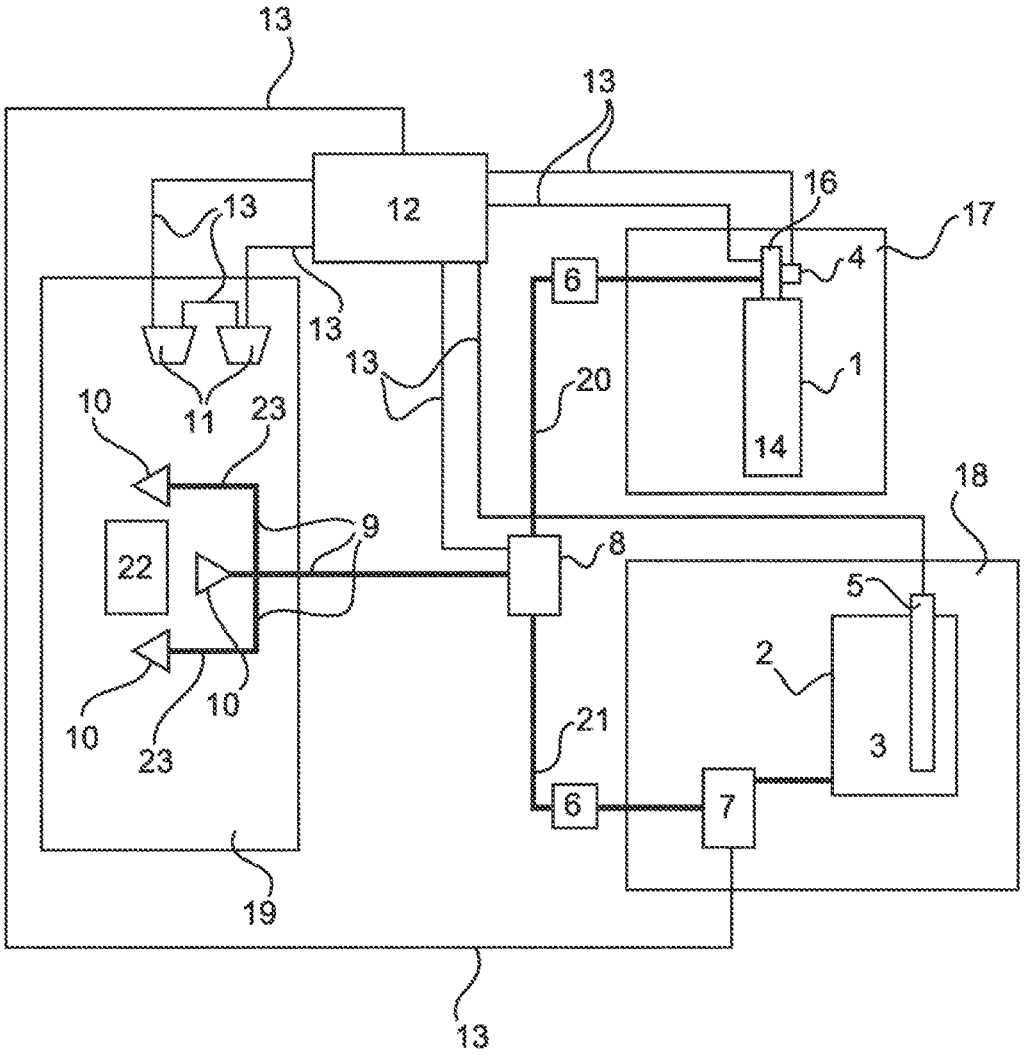
FIG. 1 is a schematic illustration of an extinguishing system with two extinguishing agent supply devices, comprising an extinguishing agent container with liquid synthetic extinguishing agent and a storage container for water.

FIG. 1 shows a schematic illustration of the system according to the disclosure for extinguishing objects and devices, comprising a first extinguishing agent supply device 17 with a liquid synthetic extinguishing agent 14 in an extinguishing agent container 1, at which a valve 16 is arranged. The liquid synthetic extinguishing agent is superimposed with nitrogen. The nitrogen superimposition pressure is 50 bar.

The second arranged extinguishing agent supply device 18 comprises a water storage container 2 with water 3 or a water-based extinguishing agent, and a supply device 7, which generates the volumetric flow and pressure for the water or the water-based extinguishing agent.

A first supply line 20 guides the liquid synthetic extinguishing agent 14 to the separation apparatus 8 and via a common pipe 9 and to at least one nozzle 10 after the valve 16 has been opened. In the illustrated exemplary embodiment, 3 nozzles are depicted; these are situated in the protected region 19 in which the object 22 to be protected, the object 22 to be extinguished, is acted on with extinguishing agent in the case of fire. The separation apparatus 8, the common pipe 9 and the nozzles 10 are embodied in such a way that they initially guide the liquid synthetic extinguishing agent 14 and subsequently, where necessary, water 3 or a water-based extinguishing agent to the object to be extinguished.

Figure 2:
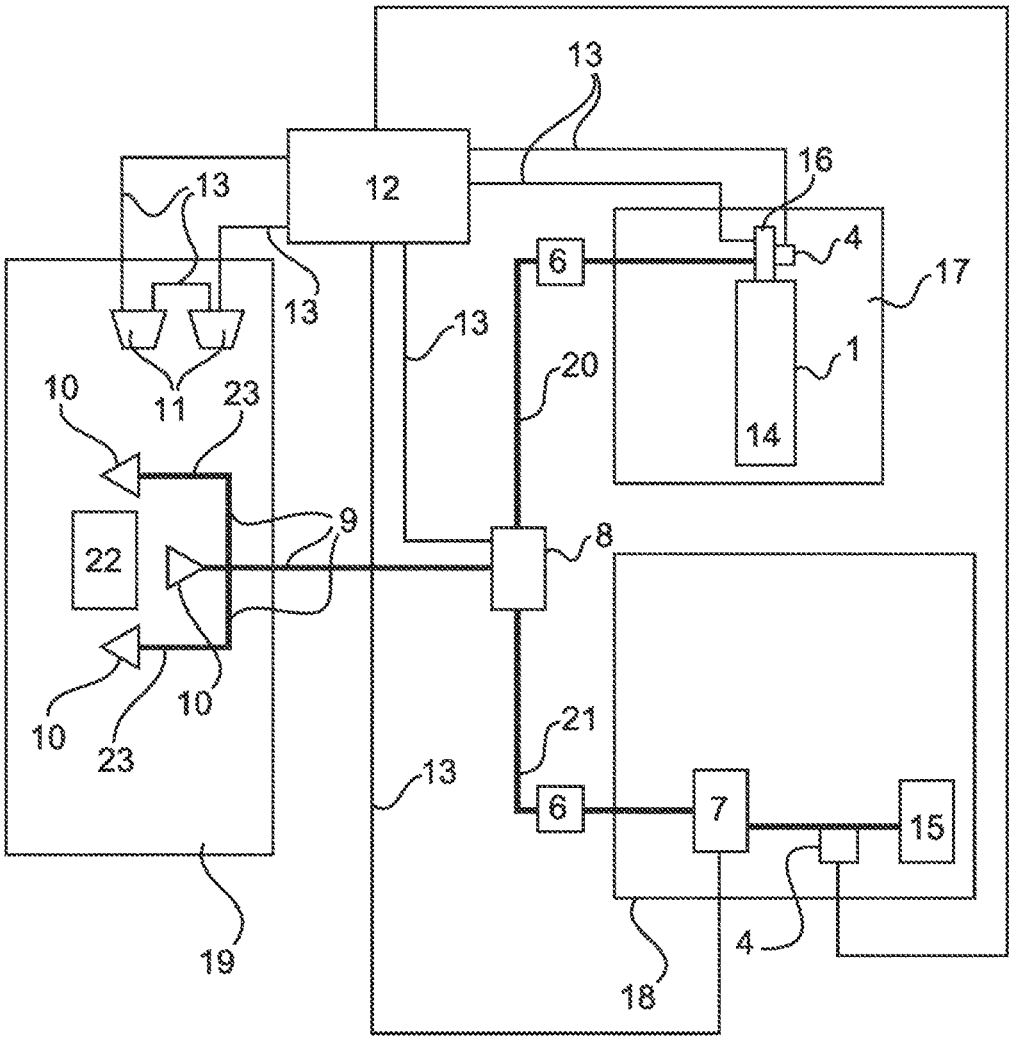
FIG. 2 is a schematic illustration of an extinguishing system with two extinguishing agent supply devices, comprising a water supply device in the second extinguishing agent supply device.

FIG. 2 shows an embodiment variant of the system, in which a water supply device 15, preferably the public water supply, is arranged in place of the water storage container 2; all other constituents and arrangements of this embodiment variant are identical to the system depicted in FIG. 1.

A likewise advantageous embodiment of the system, in which a water supply device 15 is arranged in addition to the water storage container 2, is not depicted here.

Two event detectors 11, which are connected to a fire alarm and/or extinguishing control panel 12 by way of the signal-conducting connection 13, are arranged in the protected region 19. A fire signal is detected by the fire alarm and/or extinguishing control panel 12 by way of this signal-conducting connection 13. The fire alarm and extinguishing control panel 12 is embodied and configured in such a way that it actuates and opens the valve 16, when a first fire signal is detected at the time $t_1$, for the purposes of discharging the liquid synthetic extinguishing agent 14 with the pressurized nitrogen from the extinguishing agent container 1. The liquid synthetic extinguishing agent 14 reaches the object 20 to be extinguished in the protected region 19 by way of the common pipe 9 and the three nozzles 10. The common pipe 9 contains a distribution pipe network 23, which guides the extinguishing agents to the nozzles 10 which are arranged at predefined positions around the object 22 to be protected. The predefined positions are determined in such a way that the fire can be extinguished in the shortest amount of time with a minimal amount of extinguishing agent.

After complete discharge of the liquid synthetic extinguishing agent 14, the event detectors 11 examine whether the fire is extinguished. This is the case if no fire signal is detected via the event detectors 11 and the fire alarm and/or extinguishing control panel 12 within a predetermined monitoring duration $t_b$ starting from the time $t_1$.

If a second fire signal is detected at the time $t_2$, the fire alarm and/or extinguishing control panel 12 additionally actuates the conveying device 7 which discharges the water 3 or the water-based extinguishing agent from the storage container 2 in the exemplary embodiment from FIG. 1, or the water from the water supply device 15, by way of the common pipe 9 and the nozzles 10 for extinguishing the object 22 in the protected region 19.

A pressure monitoring device 4 is arranged at or in the extinguishing agent container 1. Water 3 is supplied by way of a storage container 2 with a fill-level monitoring device 5 arranged at or in the container, or from a water line of the public water supply 15 (FIG. 2), which is likewise equipped with a pressure monitoring device 4. The necessary pressure and volumetric flow for discharge are obtained by the conveying device 7.

The fill-level monitoring device 5 and the pressure monitoring device 4 are connected to the fire alarm and/or control panel 12 in a signal-conducting manner, by way of the signal-conducting connection 13 in the depicted example, which is preferably embodied as an electric line. Pressure and fill-level are detected and monitored by the fire alarm and/or extinguishing control panel 12. If predetermined thresholds are dropped below and/or exceeded, this is transmitted to a predetermined reception and/or notification device. The conveying device 7 generates the volumetric flow and pressure required for discharging the water 3. The extinguishing agent container 1 with the liquid synthetic extinguishing agent 14 is connected to the separation apparatus 8 by way of the first supply line 21 and the conveying device 7 for the water 3 or the water-based extinguishing agent is connected to the separation apparatus 8 by the second supply line 22. From the separation apparatus 8, the common pipe 9 guides the extinguishing agent to the nozzles 10 in the protected region 19. The separation apparatus 8 ensures that in each case only one extinguishing agent is situated in the pipe 9 and the water 3 or the water-based extinguishing agent and the liquid synthetic extinguishing agent 14 are kept separately.

FIG. 1 shows that return flow preventers 6 are arranged in front of the extinguishing agent supply devices 17 and 18, i.e. downstream of the extinguishing agent supply apparatuses 17, 18. They prevent an ingress of water 3 or a water-based extinguishing agent into the first extinguishing agent supply device 17 and an ingress of a liquid synthetic extinguishing agent 14 into the second extinguishing agent supply device 18. A return flow preventer 6 is respectively arranged between the extinguishing agent container 1 and the separation apparatus 8, and between the conveying device 7 and the separation apparatus 8.

From the separation apparatus 8, the pipe 9 leads to the nozzles 10, which discharge the liquid synthetic extinguishing agent 14 and, if necessary, the water 3 thereafter onto the object 20 to be protected and to be extinguished. For the purposes of being actuated, the conveying device 7, the valve 16 at the extinguishing agent container 1 and the separation apparatus 8 are connected in a signal-conducting manner to the fire alarm and/or extinguishing control panel 12. In the exemplary embodiments depicted in FIGS. 1 and 2, the signal-technical connection 13 is realized by way of electric lines, which are monitored by the fire alarm and/or extinguishing control panel 12 in respect of a wire break and/or a short-circuit in order to immediately identify and report malfunctions. The wireless embodiment variant of the signal-conducting connection 13 is not depicted here.

The first and second extinguishing agent supply devices 17, 18 are actuated by way of this signal-conducting connection 13, i.e. the valve 16 is actuated in the case of a first fire signal, said valve open the extinguishing agent container 1, and the conveying device 7 is actuated in the case of a second fire signal within the predetermined monitoring duration $t_b$. By way of these actuations, the respective extinguishing agent is discharged by way of the common pipe 9 and the nozzles 10 and the fire is fought at, or in, the object 22 to be extinguished.

The fire alarm and/or extinguishing control panel 12 depicted in FIG. 1 and FIG. 2 is embodied and configured in such a way that, if it detects a second fire signal at the time $t_2$, it actuates the separation apparatus 8 prior to actuating the second extinguishing agent supply device 18, for the purposes of generating a switch position of the separation apparatus 8 which releases the transport path of the water 3 or the water-based extinguishing agent in the direction of the common pipe 9 and the nozzles 10 and completely blocks the transport path of the liquid synthetic extinguishing agent 14 from the first extinguishing agent supply device 17 in the direction of the common pipe 9 and the nozzles 10.

This switching state of the separation apparatus is the secondary switching state of the separation apparatus 8 since the second extinguishing stage with water 3 or a water-based extinguishing agent only occurs where necessary if the first extinguishing stage with the liquid synthetic extinguishing agent 14 has not led to extinguishment and if a second fire signal is detected.

The fire alarm and/or extinguishing control panel 12 is furthermore embodied and configured in such a way that it actuates the separation apparatus 8, prior to actuating the first extinguishing agent supply device 17, for the purposes of generating a switch position of the separation apparatus 8 which releases the transport path of the liquid synthetic extinguishing agent 14 in the direction of the common pipe 9 and the at least one nozzle 10 and completely blocks the transport path of the water 3 or the water-based extinguishing agent from the second extinguishing agent supply device 18 in the direction of the common pipe 9 and the at least one nozzle 10. This switching position of the separation apparatus is the primary switching position of the separation apparatus 8 since the first extinguishing stage is carried out with the liquid synthetic extinguishing agent 14. This actuation of the separation apparatus 8 can be dispensed with if it is already in this primary switching state prior to actuating the first extinguishing agent supply device 17.

After the liquid synthetic extinguishing agent 14 was discharged, the residual nitrogen flows thereafter and removes all residues of the synthetic extinguishing agent 14 from the pipe 9. Hence, there is purging of the common pipe 9 and the at least one nozzle 10 with a gas, nitrogen in this embodiment, after actuating the first extinguishing agent supply device 17 and before actuating the second extinguishing agent supply device 18.

In the extinguishing systems depicted in FIG. 1 and FIG. 2, nozzles with only one nozzle bore and a widening opening are used for the at least one nozzle, in this case three nozzles, for the liquid discharge of the synthetic extinguishing agent. As result, a target-directed extinguishing agent jet with the geometry of a cone, preferably a full cone, arises, as does a high extinguishing agent density. The target-directed compact form of the jet generates a type of tunnel effect such that the contact faces of the liquid synthetic extinguishing agent with the ambient air are small and an evaporation of the liquid synthetic extinguishing agent as a result of the ambient air only takes place at the front shock front and the lateral sides of the extinguishing agent jet. Therefore, the synthetic extinguishing agent remains largely liquid in the center of this cone until it reaches the seat of the fire.

Figure 3:
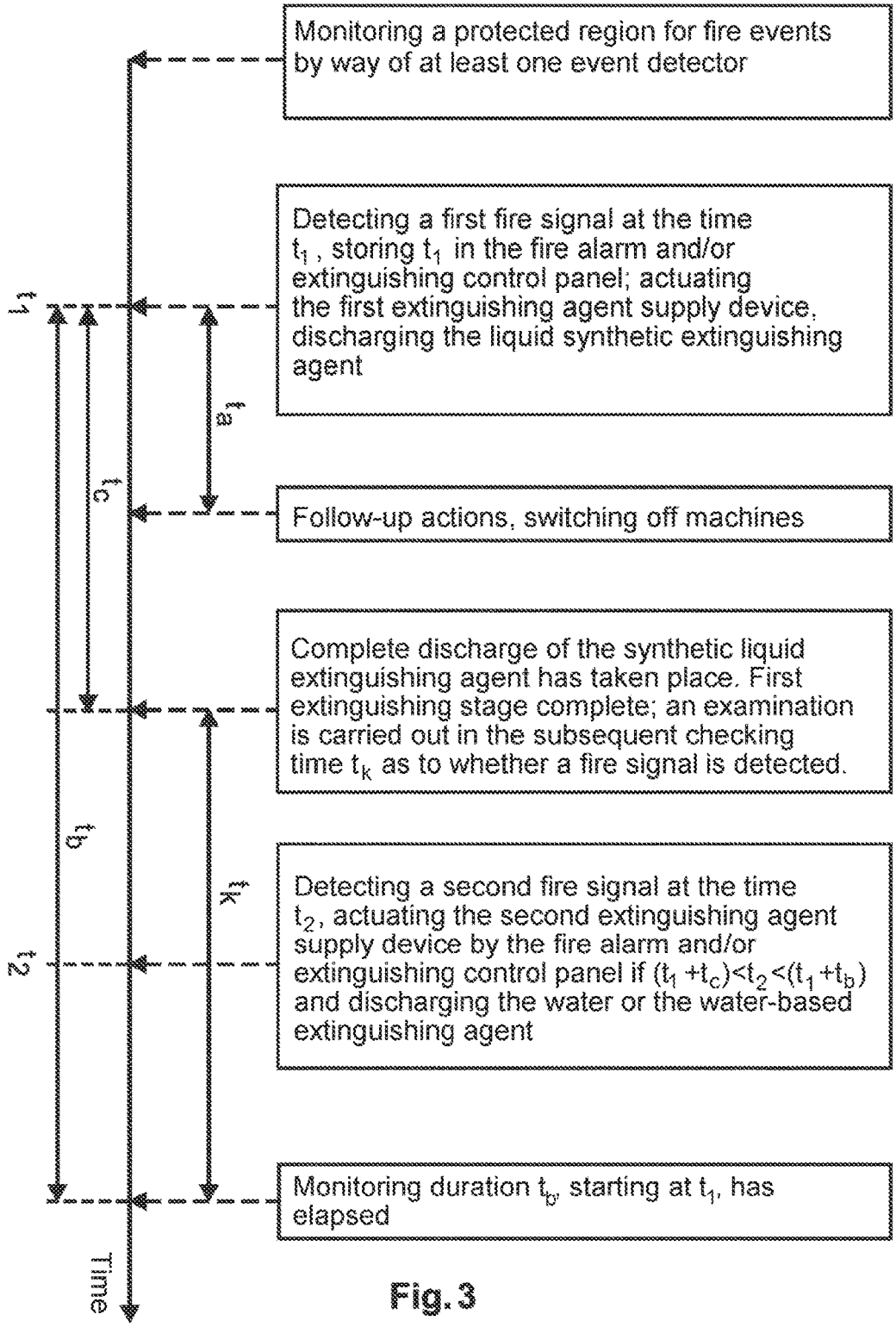
FIG. 3 schematically depicts the temporal progress of the method steps.

FIG. 3 schematically depicts the temporal progress of the method steps of a particularly preferred embodiment of the method for extinguishing objects or devices using two different liquid extinguishing agents 3, 14, which are provided by two separate extinguishing agent supply devices 17, 18 by way of a separation apparatus 8 and a common pipe 9 and at least one nozzle 10. Here, the first extinguishing agent supply device 17 provides a liquid synthetic extinguishing agent 14, preferably in an extinguishing agent container 1, and the second extinguishing agent supply device 18 provides water 3 or a water-based extinguishing means in a water storage container 2 or from a water supply device 15.

A first fire signal is detected at the time $t_1$ by at least one event detector 11 and a fire alarm and/or extinguishing control panel 12. As a result, the first extinguishing agent supply device 17 is actuated by the fire alarm and/or extinguishing control panel 12 for discharging the liquid synthetic extinguishing agent 14 via the separation apparatus 8, the common pipe 9 and the at least one nozzle 10.

If a second fire signal is detected at the time $t_2$, the second extinguishing agent supply device 18 is actuated and the water 3 or the water-based extinguishing agent is discharged for extinguishing purposes by way of the separation apparatus 8, the common pipe 9 and the at least one nozzle 10.

Here, the second extinguishing agent supply device 18 is only actuated if the time $t_2$ after the complete discharge of the extinguishing agent container 1 is after the discharge time $t_c$ has expired but within a monitoring duration $t_b$, wherein the monitoring duration $t_b$, starting from the time $t_1$, is the sum of the discharge time $t_c$ and a checking time $t_k$, wherein the checking time $t_k$ follows the discharge time $t_c$ and, during this time $t_k$, the fire alarm and/or extinguishing control panel (12) examines whether a fire signal is detected and the time $t_2$ satisfies the inequality $(t_1+t_c)<t_2<(t_1+t_b)$.

LIST OF UTILIZED REFERENCE SIGNS

1 Extinguishing agent container 1 for a liquid synthetic extinguishing agent
2 Storage container for water or a water-based extinguishing agent
3 Water or a water-based extinguishing agent
4 Pressure monitoring device
5 Fill-level monitoring device
6 Return flow preventer
7 Conveying device
8 Separation apparatus
9 Common pipe
10 Nozzle
11 Event detector
12 Fire alarm and/or extinguishing control panel
13 Signal-conducting connection
14 Liquid synthetic extinguishing agent
15 Water supply device
16 Valve
17 First extinguishing agent supply device
18 Second extinguishing agent supply device
19 Protected region
20 First supply line
21 Second supply line
22 Object to be extinguished
23 Distribution pipe network

The invention claimed is:

1. A method for extinguishing objects or devices, comprising the following method steps preferably carried out in succession:

(a) detecting a first fire signal of a fire characteristic by at least one event detector (11) and at least one of a fire alarm or an extinguishing control panel (12), at the time t1, (b) actuating a first extinguishing agent supply device (17) by the at least one of a fire alarm or an extinguishing control panel (12) for discharging a liquid synthetic extinguishing agent (14) by way of a common pipe (9) and at least one nozzle (10), (c) detecting a second fire signal of the fire characteristic at the time t2 and (d) actuating a second extinguishing agent supply device (18) and delivering one of a water (3) or a water-based extinguishing agent via the common pipe (9) and at least one nozzle (10) for extinguishing purposes, wherein the discharge of the liquid synthetic extinguishing agent (14) and the delivery of the water (3) or the water-based extinguishing agent is carried out by a separation apparatus (8) and wherein, furthermore, there is an actuation of the separation apparatus (8) by the at least one of a fire alarm or an extinguishing control panel (12), prior to method step (b), for generating a switching position, which releases a transport path of the liquid synthetic extinguishing agent (14) in the direction of the common pipe (9) and the at least one nozzle (10) and completely blocks the transport path of the one of a water (3) or the water-based extinguishing agent from the second extinguishing agent supply device (18) in the direction of the common pipe (9) and the at least one nozzle (10) and there is an actuation of the separation apparatus (8) by the at least one of a fire alarm or an extinguishing agent control panel (12), prior to method step (d) and complete discharge of the liquid synthetic extinguishing agent (14), for generating a switching position of the separation apparatus (8) which releases the transport path of the at least one of a water or the water based extinguishing agent (3) in the direction of the common pipe (9) and the at least one nozzle (10) and completely blocks the transport path of the liquid synthetic extinguishing agent (14) from the first extinguishing agent supply device (17) in the direction of the common pipe (9) and the at least one nozzle (10).

2. The method as claimed in claim 1, wherein there is purging of the common pipe (9) and of the at least one nozzle (10) with a gas after method step (b) of claim 1.

3. The method as claimed in claim 1, wherein the volumetric flow of the synthetic extinguishing agent (14) emerging from the nozzle (10) is formed as a target-directed extinguishing agent jet with the geometry of a cone such that the synthetic extinguishing agent remains largely liquid in the center of the cone until the synthetic extinguishing agent reaches the action zone.

4. The method as claimed in claim 1, wherein the time $t_2$ after the complete discharge of the extinguishing agent container (1) lies after the expiry of a discharge time $t_c$ but within a monitoring duration $t_b$, wherein the monitoring duration b is the sum of the discharge time $t_c$ and a checking time $t_k$ starting from the time $t_1$, where the checking time $t_k$ follows the discharge time $t_c$, and furthermore comprising the following step:

examining whether a fire signal is detected during the time $t_k$, in particular by the fire alarm and/or extinguishing control panel (12), and whether the inequality $(t_1+t_c)<t_2<(t_1+t_b)$ is satisfied at the time $t_2$.

5. The method as claimed in claim 1, wherein the liquid synthetic extinguishing agent (14) constitutes a non-flammable, non-ignitable, electrically non-conductive liquid with at least one of a vapor pressure of 0.1 to 3 bar at 21° C. or a density of 1400 kg/m3 to 1800 kg/m3 at a temperature of 21° C.

6. The method as claimed in claim 1, wherein the liquid synthetic extinguishing agent (14) constitutes one of an FK-5-1-12($C_4F_9OCH_3$) or a fluoro ketone.

* * * * *